United States Patent [19]

Wiholm

[11] 4,367,061

[45] Jan. 4, 1983

[54] METHOD AND APPARATUS FOR PRODUCING BOOK COVERS, FOLDERS, BOOKLETS AND THE LIKE

[75] Inventor: Sture Wiholm, Stockholm, Sweden

[73] Assignee: Semotex Aktiebolag, Stockholm, Sweden

[21] Appl. No.: 132,257

[22] Filed: Mar. 20, 1980

[30] Foreign Application Priority Data

Mar. 30, 1979 [SE] Sweden ..... 7902871

[51] Int. Cl.[3] ..... B42C 7/00

[52] U.S. Cl. ..... 412/3; 412/17

[58] Field of Search ..... 11/2, 4, 1 AD, 1 CD, 11/1 CP, 1 B, 1 D, 5; 493/60, 61, 343, 344, 354, 355, 396, 402, 403; 156/211, 477 B; 412/4, 8, 19, 22

[56] References Cited

U.S. PATENT DOCUMENTS

| | | | |
|---|---|---|---|
| 1,302,831 | 5/1919 | Naugler | 493/396 |
| 3,137,874 | 6/1964 | Hildmann | 156/477 B |
| 3,228,709 | 1/1966 | Tooker | 11/2 X |
| 3,314,089 | 4/1967 | Margolis | 11/2 |
| 3,451,082 | 6/1969 | Sarring | 11/1 R |
| 3,454,694 | 7/1969 | Delaire | 11/2 X |
| 3,532,363 | 10/1970 | Abildgaard | 11/2 X |
| 3,708,813 | 1/1973 | Carter | 11/5 X |
| 4,009,498 | 3/1977 | Staats | 11/1 AD |
| 4,129,471 | 12/1978 | Rome | 156/211 |
| 4,129,914 | 12/1978 | Jahn | 11/2 |
| 4,195,557 | 4/1980 | Kang | 493/354 X |

*Primary Examiner*—Paul A. Bell
*Assistant Examiner*—John S. Brown
*Attorney, Agent, or Firm*—Dressler, Goldsmith, Shore, Sutker & Milnamow, Ltd.

[57] ABSTRACT

In a method for producing book covers, a folder, a booklet or the like having a blank (7) with at least one cover and a spine (3) connected thereto via at least one crease line (4, 5) and a bonding agent or binder for adhering pages or the like inserted in the book covers, folder, booklet or the like to the inside of the spine. To this end the binder is placed in the form of a strip (6') on a base (13) so that both longitudinal side edges of the strip are oriented between two creasing means (11, 12) projecting above the surface of the base, and the blank is aligned into a predetermined position above the base and creasing means, there also being a press means (14) for pressing the blank against the creasing means and strip to form the crease lines and to attach the strip to the inside of the spine. An apparatus for carying out the method comprises a base (9, 10) for the strip (6'), creasing means (11, 12) for orienting the strip, and a press means (14). In an alternative embodiment of the invention, the strip (6') is cut from a roll or sheet of material (16) by a cutting means (18) which also serves as base for the strip while the latter is pressed into adherence against the inside of the spine of the blank (7), which has been provided with the crease lines (4, 5) during a previous work operation.

18 Claims, 5 Drawing Figures

METHOD AND APPARATUS FOR PRODUCING BOOK COVERS, FOLDERS, BOOKLETS AND THE LIKE

TECHNICAL FIELD OF INVENTION

The present invention relates to a method and apparatus for producing book covers, folders, booklets or the like having a blank with at least one cover and a spine joined thereto by means of at least one crease line, and a binding agent for bonding sheets or pages inserted in the booklet or covers against the inside of said spine.

BACKGROUND OF THE INVENTION

Book covers, folders and booklets of the kind described above are already known. They generally comprise a cardboard or plastics material, which is provided with a spine and two covers joined thereto via two crease lines, said covers enclosing a plurality of sheets of paper. In producing the blank comprising covers and spine, a sheet or roll of material is cut to the desired format, the blank being provided with two crease lines defining the spine. In order that said sheets of paper shall be attached to the spine, it is coated with a bonding agent or binder, subsequent to which the sheets of paper are pushed into the binder, which is then allowed to harden.

Binders of thermosetting type have recently begun to be used to rationalize the manufacture of folders and booklets. Such a binder is in a solid state at room temperature, and is supplied in large sheets or rolls from which strips are cut. A strip is attached to the inside of the spine by placing it between the crease lines and thereafter heating it so that the binder melts and adheres to the inside of the spine. When the binder has hardened, the book covers are taken to a binding machine together with the pages which are to be enclosed between the covers, with the edges of the sheets in contact with the strip attached to the inside of the spine. The strip is heated by the machine, the edges of the sheets being surrounded by viscous binder. After cooling the sheets are rigidly attached to the spine.

The above-described method of manufacturing folders or booklets is comparatively effective, but necessitates a plurality of work operations. Furthermore, during the process it is difficult to orient the strip exactly on the inside of the spine between the crease lines, which is necessary if all the sheets along the whole of their length are to make contact with the strip and adhere firmly thereto, and if the crease lines are to be kept free from binder and the covers are to be bent as intended, without any obstruction.

SUMMARY OF THE INVENTION

The present invention provides an improved method and apparatus of the kind described in the introductory paragraph, (Technical field of the invention) by the aid of which the above-mentioned disadvantages of previously known methods and apparatus are circumvented. This is achieved by the invention having been given the distinguishing features disclosed in the patent claims.

The foremost advantages of the invention are that the strip consisting of the binder is adhered to the spine of the folder during the same work operation as the crease lines between spine and covers are formed, and that the strip is thereby exactly oriented between the crease lines formed.

According to a modification of the invention, the strip is cut from a sheet or roll of material during the same work operation as the strip is taken into engagement against the inside of the spine, which has been provided with crease lines, one work operation thus being dispensed with.

DETAILED DESCRIPTION OF THE PREFERRED EMBODIMENTS

Figure 1:
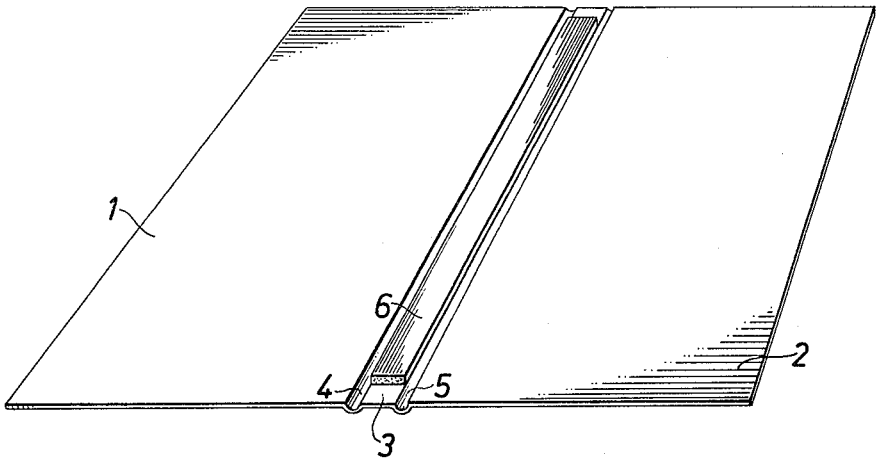
FIG. 1 is a perspective view of a folder produced in accordance with the inventive method, seen from the inside and in a folded-out, flat condition.

The folder illustrated in FIG. 1 and manufactured in accordance with the inventive method comprises a cardboard blank with two covers 1 and 2 and a spine 3, which is connected to the covers via crease lines 4 and 5 extending over the whole height of the folder. On the inside of the spine 3 there is attached a binder in the form of a glue strip 6 in a solid condition. When pages (not shown) are to be fixed in the folder, the sides 1 and 2 are folded upwardly along the crease lines 4 and 5 so that they become substantially mutually parallel, the pages being inserted between the sides 1 and 2 so that longitudinal edges thereof rest against the strip 6. The folder and pages are then inserted in a binding machine (not shown) known per se, where the strip 6 is heated so that the pages penetrate the viscous outer layer of the strip. After the strip 6 has cooled, the pages are firmly connected to the spine 3 of the folder.

Figure 2:
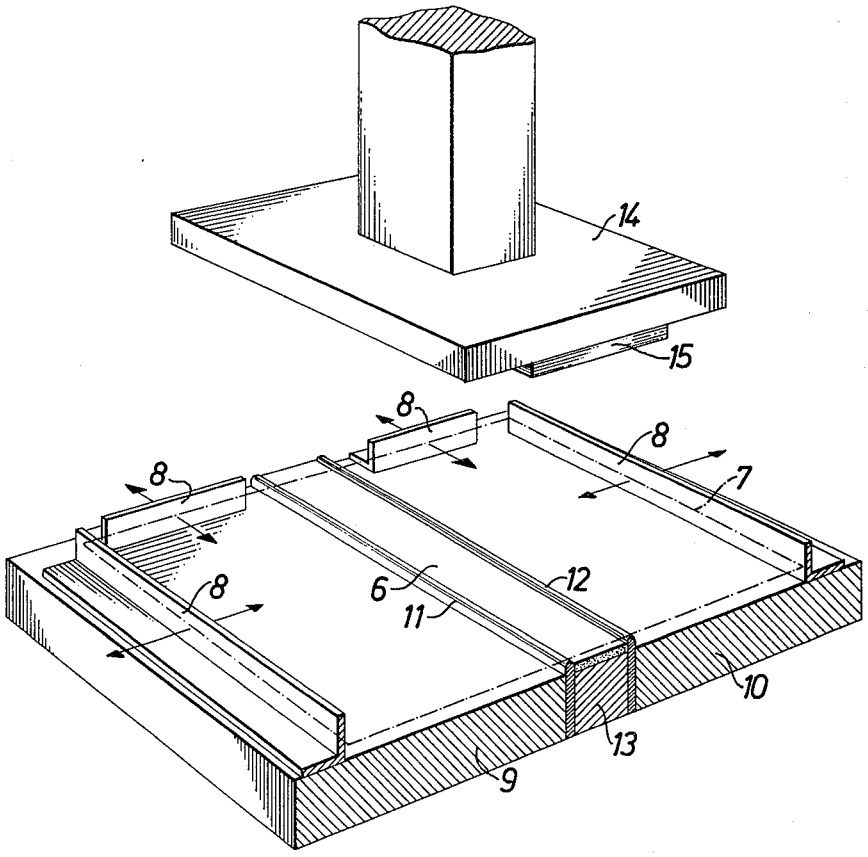
FIG. 2 is a perspective view of an apparatus in accordance with principles of the present invention for carrying out the inventive method.

A flat cardboard blank 7 is indicated by chain-dotted lines in FIG. 2, and the blank is to be provided in accordance with the invention with crease lines 4, 5 and strip 6. The blank 7 is aligned by displaceable rails 8 into a correct position in a horizontal plane. A bottom plate with two parts 9 and 10 support the outer parts of the blank 7. Creasing means in the form of metal strips 11 and 12 are attached to the mutually opposing side edges of the parts 9, 10, said strips 11, 12 carrying the central portion of the blank 7 and being somewhat longer than the height of the blank. A plate 13 is mounted between the strips 11 and 12, and forms a base for the strip 6. The width of the strip 6 is only slightly smaller than the distance between the strips 11 and 12 and can therefore not be displaced relative thereto. The thickness of the strip 6 is preferably somewhat less than the distance between the upper surface of the plate 13 and the upper edges of the strips 11, 12.

After the strip 6 and blank 7 have been placed in their positions illustrated in FIGS. 1 and 2, a reciprocally movable press means 14 situated above the plates 9, 10, 13 is displaced towards them. The underside of the press means 14 is provided with a plate 15 of resilient material, e.g. silicon rubber, which is deformed when it is pressed against the strips 11 and 12 under comparatively high pressure, and thereby providing the depressions in the form of crease lines 4, 5 in the blank 7 between the strips and plate 15, so that the blank is separated into covers 1, 2 and spine 3. Instead of making the plate 15 from resilient material, it can be made of metal, although elongate recesses situated above the strips 11, 12 and which can accommodate said strips must be made in the plate.

When then plate 15 of the press means presses blank 7 against the strips 11, 12, the portion of blank 7 between the strips which provides spine 3 comes into contact with the strip 6, simultaneously pressing it against the plate 13. Above the plate 15 in the press means 14 there is a heating element 16 which heats the strip 6 during the pressing operation so that it becomes viscous, whereat its upper surface adheres to the spine 3. If the strip 6 is provided on its upper surface with a self-adhesive material, heating is not required. In this case, the strip 6 adheres to the spine as soon as the spine 3 is pressed into engagement against the upper surface of the strip.

In order that the apparatus shown in FIGS. 1 and 2 can be suited to the manufacture of different-sized folders with spines 3 of different widths, the plate 13 can be exchanged for plates of other width.

Figure 3:
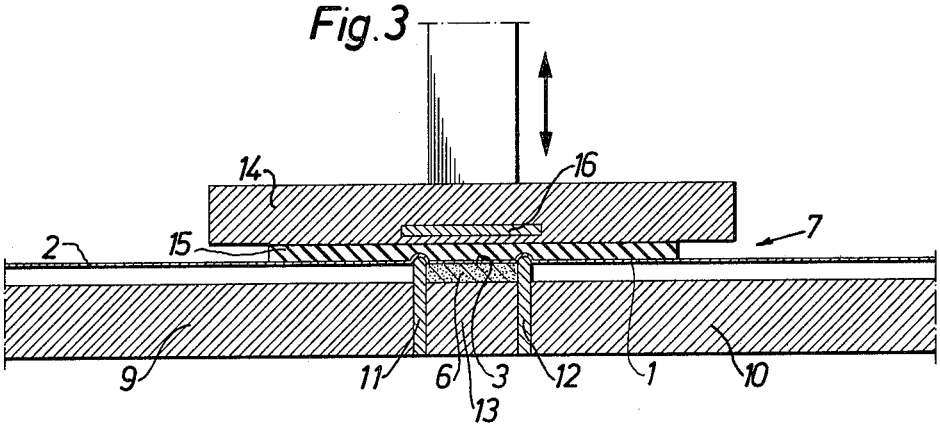
FIG. 3 is a side view, partially in section, of a portion of the apparatus illustrated in FIG. 2, and FIGS. 4 and 5 are side views, partially in section, of two further embodiments of the apparatus in accordance with the invention.
Figure 4:
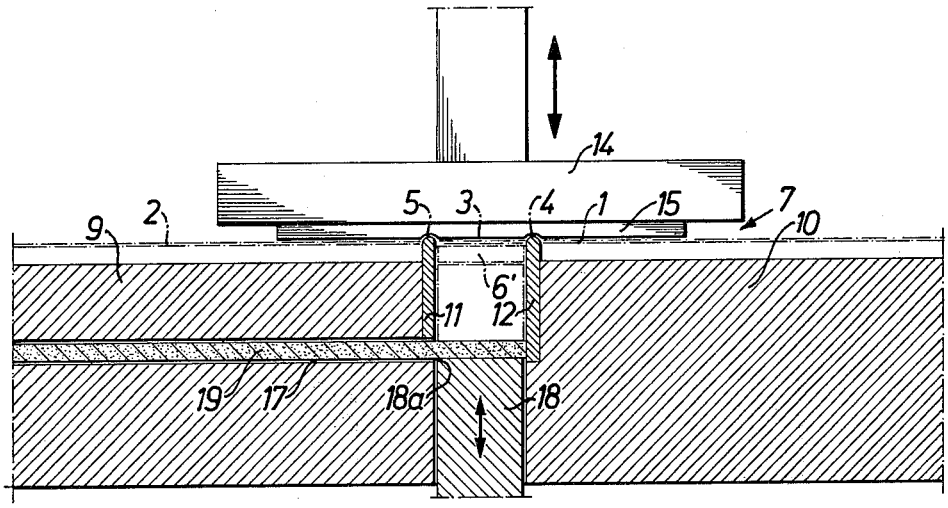

A modification of the apparatus according to FIGS. 2 and 3 is shown in FIG. 4. The press means 14, strips 11 and 12 and bottom plate 10 are identical with corresponding details in FIG. 3. The bottom plate 9 is, however, provided with a slit 17 through which the forward portion of a roll or sheet 19 of binder is insertable. After the edge of the forward portion has been taken into engagement against the side wall of the plate 10, a punch 18, with a width which is slightly less than the distance between the strips 11 and 12 and with a length approximately corresponding to that of the strips, is taken upwards from the position shown in FIG. 4, its sharp upper left edge 18*a* cutting the forward edge of the material 19 against the underside of the strip 11 so that a strip 6', corresponding to the strip 6, is formed. The strip 6' is taken further upwards by the punch 18, on the upper surface of which it rests, into the position shown by dashed lines in FIG. 4. In this position the upper flat surface of the punch 18 serves as a solid base corresponding to the plate 13 (in FIGS. 2 and 3) for the strip 6', and is kept in this position during the action of the press means 14. After the strip 6' has adhered to the blank 7, the punch is returned to its lower position shown in FIG. 4, whereafter the forward edge of the roll or sheet of material 19 is once again urged towards the side wall of the plate 10.

The apparatus illustrated in FIG. 4 can also be used for attaching the strip 6' to the spine 3 of a blank 7, which has been provided with the crease lines 4, 5 during a previous work operation. The blank 7 with crease lines 4, 5 is in this case aligned in the same way as previously described, and so that the upwardly convex crease lines rest on the upper edges of the strips 11, 12. The punch 18 is then moved upwards, whereat it cuts off the strip 6' from the roll or sheet 19 and takes the strip into engagement against the inside of the spine 3. The punch 18 is retained in this position and thus forms a base for the strip when the press means 14 subsequently presses the strip against the outside of the spine. Instead of allowing the press means 14 to press the spine 3 downwards while the punch 18 assumes the position shown by dashed lines in FIG. 4, the press means can, after the blank 7 has been placed in the position illustrated in the Figure, be taken downwards into engagement against the blank and be retained in this position, whereafter the punch presses the strip 6' upwards into engagement with the spine.

Figure 5:
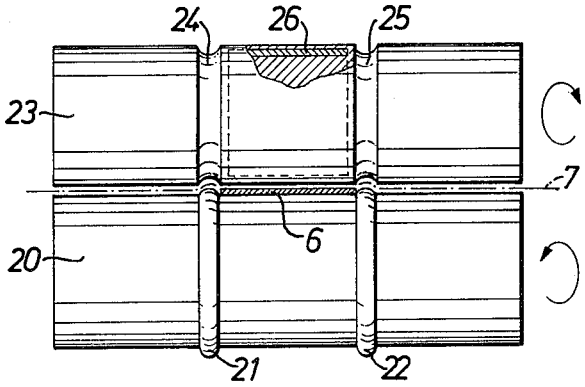

Another embodiment of the creasing means, press means and base for the strip 6 is illustrated in FIG. 5. Here the creasing means comprises two light flats 21 and 22 attached to and upstanding from a roller 20, said flats going round the entire circumference of the roller, and the base for the strip 6 comprising the circumference of the roller between the flats. The press means comprises a roller 23 provided with two grooves 24, 25 around the whole of the circumference of the roller 23 and spaced from each other in correspondence with the spacing between the flats 21 and 22. The flats 21 and 22 of the roller 20 partially project into the grooves 24 and 25 of the roller 23. When the crease lines 4 and 5 on the blank 7 are to be formed, and the strip 6 is to be adhered to the spine 3 of the blank, the strip 6 and blank 7 are substantially simultaneously inserted in the nip between the rollers 20 and 23 while these are rotated in opposite directions, the flats 21, 22 and recesses 24, 25 successively form the crease lines, while the surface of the roller between the recesses 24 and 25 presses the strip 6 towards the surface between the flats 21 and 22 on the roller 20, the strip thus successively being adhered to the spine 3. For attaching the strip 6 to the spine 3, the upper surface of the strip can be provided with a self-adhesive material layer, or a heating element 26 can be arranged in the roller 23. Instead of the grooves 24 and 25, the roller can be provided with a resilient surface layer, the function of which corresponds to that of the plate 15 in FIGS. 2–4.

It should be understood that the invention is not limited to the embodiments described above and illustrated on the drawings. Thus, the crease lines 4 and 5 do not need to be continuous, for example, but can consist of weak placed of different lengths and at different distances from each other. It is also possible to provide several parallel crease lines outside the crease lines 4, 5 if such should be found desirable. The method is also applicable to the manufacture of book covers, folders, booklets and the like with only one proper cover. The invention is thus only limited by the scope defined in the patent claims.

I claim:

1. A method of producing a book cover and the like from a blank, the book cover including at least one cover, a spine connected to the cover by at least one crease line, and a bonding agent for adhering pages and the like inserted in the book cover to the spine, comprising the steps of:

forming said bonding agent as a strip;

placing the strip on a base so that at least one of the longitudinal side edges of the strip is oriented relative to at least one creasing means projecting above the surface of said base;

aligning the blank to a predetermined position relative to the base and the creasing means, and pressing the blank, and the creasing means and the strip, against each other with press means to form said crease line in the blank to form the cover and the spine of the book cover and to attach the strip to the inside of the spine.

2. A method as recited in claim 1, including placing said strip on said base between a pair of elongate, parallel creasing means, and pressing said blank and said pair of creasing means against each other to form a pair of crease lines defining said spine so that said strip is substantially simultaneously attached to the inside of the spine.

3. A method as recited in claim 2, including cutting said strip from a piece of material to a width corresponding to the distance between said creasing means with cutting means provided on said base.

4. A method as recited in claim 1, including the step of:

supplying heat to at least one of said strip and said spine while the blank, and the creasing means and said strip, are pressed against each other.

5. An apparatus for producing a book cover and the like from a blank, the book cover including at least one cover, a spine connected to the cover by at least one creased line, and a bonding agent for binding pages and the like inserted in the book cover to the inside of the spine, comprising:

a base having a support surface for carrying the bonding agent in the form of a strip;

at least one creasing means projecting above and adjacent to the support surface of the base and mounted in association with the base for orienting said strip relative to the base; and press means movable toward said support surface for pressing the blank aligned relative to the base and the creasing means, and the creasing means and strip, against each other to form the creased line in the blank to form the cover and the spine of the book cover and to attach the strip to the inside of the spine.

6. An apparatus as recited in claim 5, wherein said base is situated between a pair of parallel creasing means for orienting opposed longitudinal edges of said strip and for forming a pair of creased lines on respective opposite sides of the strip, said creased lines defining said spine and connecting said spine to two covers of the book cover.

7. An apparatus as recited in claim 5, wherein said press means comprises heat generating means for heating the strip while the blank and the strip are pressed against each other.

8. An apparatus as recited in claim 5, wherein said press means comprises a press plate displaceable away from and against said blank, said plate including a resilient material on its side facing the blank.

9. An apparatus as recited in claim 5, wherein said press means comprises a press plate displaceable away from and against said blank, said plate being formed with at least one depression fitting said creasing means.

10. An apparatus for producing a book cover and the like from a blank, the book cover including at least one cover, a spine connected to the cover by at least one crease line, and a bonding agent for binding pages and the like inserted in the book cover to the inside of the spine, comprising:

a base for carrying the bonding agent in the form of a strip;

at least one creasing means projecting above the surface of the base and mounted in association with the base for orienting said strip relative to the base; and press means for pressing the blank aligned relative to the base and the creasing means, and the creasing means and strip, against each other to form the crease line in the blank to form the cover and the spine of the book cover and to attach the strip to the inside of the spine, said base comprising a rotatable roller with a pair of parallel creasing means extending about the circumference of the roller, said pair of creasing means being spaced from each other a distance corresponding to the width of said strip, and said press means comprising another rotatable roller having a pair of parallel grooves extending about the circumference thereof and respectively aligned with said creasing means, said rollers being adapted to advance said blank between said creasing means and said grooves during rotation of said rollers in opposite directions to successively provide crease lines in said blank defining said spine so that said strip is positionable between the pair of creasing means and is adapted to be advanced by the rollers and successively adhered to the spine defined by the crease lines.

11. An apparatus for producing a book cover and the like from a blank, the book cover including at least one cover, a spine connected to the cover by at least one crease line, and a bonding agent for binding pages and the like inserted in the book cover to the inside of the spine, comprising:

a base for carrying the bonding agent in the form of a strip;

at least one creasing means projecting above the surface of the base and mounted in association with the base for orienting said strip relative to the base; and press means for pressing the blank aligned relative to the base and the creasing means, and the creasing means and strip, against each other for form the crease line in the blank to form the cover and the spine of the book and to attach the strip to the inside of the spine, said base comprising a rotatable roller with a pair of creasing means extending about the circumference of the roller, said pair of creasing means being spaced from each other a distance corresponding to the width of said strip, and said press member comprising another rotatable roller having a resilient outer layer of material, said rollers being adapted to advance said blank between said creasing means and said outer layer of material during rotation of said rollers in opposite directions to successively provide crease lines in said blank defining said spine so that said strip is positionable between the pair of creasing means and is adapted to be advanced by the rollers and successively adhered to the spine defined by the crease lines.

12. An apparatus for producing a book cover and the like from a blank, the book cover including at least one cover, a spine connected to the cover by at least one crease line, and a bonding agent for binding pages and the like inserted in the book cover to the inside of the spine, comprising:

a base for carrying the bonding agent in the form of a strip, and at least one creasing means projecting above the surface of the base and mounted in association with the base for orienting said strip relative to the base; and press means for pressing the blank aligned relative to the base and the creasing means, and the creasing means and strip, against each other to form the crease line in the blank to form the cover and the spine of the book cover and to attach the strip to the inside of the spine, said base being exchangeable for a second base having a width differing from the width of the base and corresponding to the width of the strip.

13. An apparatus for producing a book cover and the like from a blank, the book cover including at least one cover, a spine connected to the cover by at least one crease line, and a bonding agent for binding pages and the like inserted in the book cover to the inside of the spine, comprising:

a base for carrying the bonding agent in the form of a strip;

at least one creasing means projecting above the surface of the base and mounted in association with the base for orienting said strip relative to the base; and press means for pressing the blank aligned relative to the base and the creasing means, and the creasing means and strip, against each other to form the crease line in the blank to form the cover and the spine of the book cover and to attach the strip to the inside of the spine, said base being displaceable relative to the press means: from a first position wherein a portion of a piece of bonding agent material is positionable on said base; to a second position wherein said portion is cut to form said strip; and thereafter to a third position wherein the upper surface of the strip is generally aligned with an upper longitudinal edge of the creasing means.

14. A method of producing a book cover and the like from at least one blank, said book cover including at least one cover, a spine connected to the cover by at least one crease line, and a bonding agent for adhering pages in the book cover to the inside of the spine, comprising the steps of:

cutting said bonding agent in the form of a strip from a piece of bonding agent material with cutting means which provides a base for supporting said strip during attachment of said strip to a portion of said blank providing said spine, said strip having a width substantially corresponding to the width of the spine, and attaching said strip to said portion of said blank by compressing said strip against said portion with the base of said cutting means.

15. A method as recited in claim 14, wherein the step of attaching said strip to said portion includes displacing said cutting means so that said strip supported thereon is moved into engagement with said portion of said blank, and pressing said strip and said blank against each other with press means.

16. A method as recited in claim 15, wherein said press means includes heating means for heating said strip during said pressing by said press means.

17. An apparatus for producing a book cover from a blank, said book cover including at least one cover, a spine connected to the cover by at least one crease line, and a bonding agent for adhering pages in the book cover to the inside of said spine, comprising:

means for supporting said blank;

cutting means for cutting said bonding agent in the form of a strip from a piece of bonding agent material, said strip being located in spaced aligned relationship relative to the spine of said blank;

said cutting means being mounted for movement relative to said support means; and means for moving said cutting means relative to said piece and relative to said support means to move said strip toward the portion of said blank providing said spine of said book cover.

18. An improved book cover adapted to receive at least one page or the like, comprising:

a unitary cover formed from a blank of material, said unitary cover including at least one cover portion, and a spine portion connected to said cover portion by at least one creased line, and adhesive strip means having longitudinal side edges, at least one of said side edges being generally aligned with said creased line, said book cover being formed by positioning said adhesive strip means upon a base so that at least one of the longitudinal side edges of said strip means is aligned relative to at least one creasing means projecting above the surface of said base, whereby said blank is positionable in a predetermined position relative to said base and said creasing means so that pressing together of said blank, and said creasing means and adhesive strip means, forms said creased line with said creasing means and attaches said adhesive strip means to the inside of said spine portion.

* * * * *